United States Patent [19]

Woodward

[11] Patent Number: 4,845,903

[45] Date of Patent: Jul. 11, 1989

[54] SANDBLASTING DEVICE

[75] Inventor: Michael J. Woodward, Houston, Tex.

[73] Assignee: Weatherford Italiana S.p.A., Ravenna Ra, Italy

[21] Appl. No.: 144,492

[22] Filed: Jan. 15, 1988

[30] Foreign Application Priority Data

Jan. 19, 1987 [IT] Italy ..... 47532A

[51] Int. Cl.[4] ..... B24C 5/04

[52] U.S. Cl. ..... 51/439; 51/411; 239/418

[58] Field of Search ..... 51/439, 410–411, 51/427, 319, 320, 321; 239/418, 419, 426, 591, 419.3

[56] References Cited

U.S. PATENT DOCUMENTS

| | | | |
|---|---|---|---|
| 1,813,733 | 7/1931 | Freeman | 51/439 |
| 2,387,193 | 10/1945 | Swenarton | 51/439 |
| 3,972,150 | 8/1976 | Hart | 51/439 |
| 4,341,350 | 7/1982 | Wemmer | 239/419 |
| 4,633,623 | 1/1987 | Spitz | 51/321 |

FOREIGN PATENT DOCUMENTS

| | | | |
|---|---|---|---|
| 0626074 | 7/1949 | United Kingdom | 51/439 |

*Primary Examiner*—Frederick R. Schmidt
*Assistant Examiner*—Robert A. Rose
*Attorney, Agent, or Firm*—Browdy and Neimark

[57] ABSTRACT

A sandblasting device comprises a first and a second conduit, generally parallel, which are used for the conveyance of a pressurized fluid and of sand respectively. Their outlet ends are connected to a terminal support on which is mounted a removable and orientable nozzle. This nozzle is structured and positioned in such a way as to direct the sand, through a fan-shaped jet of the pressurized fluid coming from the first conduit, on to the surface to be cleaned. The sand stream coming out of the second conduit assumes a transverse lenticular cross-section.

7 Claims, 1 Drawing Sheet

SANDBLASTING DEVICE

BACKGROUND OF THE INVENTION

1. Field of the Invention

The present invention refers to a sandblasting device used for cleaning surfaces.

Sandblasting is a means of cleaning surfaces, particularly metallic surfaces, which is very efficient and is both faster and more economical than mechanical methods. It works by throwing abrasive particles against the surface to be cleaned. Cleaning by sandblasting is, for example, widely used for the maintenance of metallic pipes, particularly those used in the petroleum and chemical industries. Various kinds of deposits left by the fluids flowing through these pipes grow on the internal surfaces to the detriment of the flow rate. Also, external surfaces are subjected to corrosion by atmospheric and chemical agents resulting in the formation of rust and other incrustations.

2. Description of the Prior Art

Up to now, sandblasting was done by throwing sand from a nozzle onto the surface to be cleaned. Before reaching the nozzle the sand was mixed with either air or water, under pressure, with such strength and velocity as to produce an abrasive action. The sand stream coming from the nozzle had a substantially conical configuration.

SUMMARY OF THE INVENTION

Object of the present invention is a sandblasting device having a first conduit for the conveyance of abrasive particles to a first outlet end and a second parallel conduit for the conveyance of a pressurized fluid to a second outlet end, comprising: a terminal support including housings wherein said outlet ends of the conduits are respectively secured; a first passage coaxial to said first conduit for a direct outlet of the abrasive particles from said support; a second passage coaxial to said second conduit for an outlet of the fluid from said second conduit; a projection integral with the support in front of said second passage, said projection having a flat external surface located near said first passage and provided with a cylindrical cavity communicating said second passage with a port on said external surface, the axis of said cavity perpendicular to said surface being inclined in such a way that it meets the axis of said first conduit at an angle; and a nozzle coaxially mounted into said cavity, said nozzle having an axial hole and a transverse groove machined across said hole at an outlet end of the nozzle, for forming a jet of pressurized fluid ejected in a fan-like spray, whereby the jet of abrasive particles coming from the first conduit is thrown against a surface to be cleaned at an angle controlled by the inclination of the axis of said nozzle and in the form of a jet having a transverse lenticular cross-section.

The purpose of the present invention, when compared to the previous technique, is to give greater advantage and efficiency making a system where sand and fluid under pressure come from different and separate outlets. It utilizes an orientable nozzle which is structured and positioned in such a way as to throw a fan-like spray of the fluid under pressure against the surface to be cleaned, in order to create a sand jet with a transverse lenticular cross-section.

Some of the advantages coming from this invention when fitted to a sandblasting system can be summarized as follows:

Better utilization of the kinetic energy of the fluid under pressure through directly deflecting the sand jet (coming out of the conveying conduit in an axial direction) onto the surface to be cleaned with a consequently greater abrasive particle impact force. This is contrary to conventional systems where the sand is always mixed with fluid under pressure, before coming out of the directional nozzle.

Longer lasting directional nozzle, improved by approximately 10 to 100 times compared to known systems using water or air under pressure.

The sand jet with transverse lenticular cross-section has a larger impact area than concal jets used in conventional systems. Also, it has a more efficient and uniform cleaning with a better energy distribution. Conical jets require more effort to achieve the same results as can be achieved with one run of this invention.

Elimination of the tendency for blockages to occur. This tendency, in conventional systems, is the reason for fluids under pressure being mixed with the sand before the directional nozzle.

Reduction in the quantity of sand required to carry out a sandblasting operation.

BRIEF DESCRIPTION OF THE DRAWINGS

The invention is best illustrate with reference to the accompanying drawings, wherein.

DETAILED DESCRIPTION OF THE PREFERRED EMBODIMENTS

Figure 1:
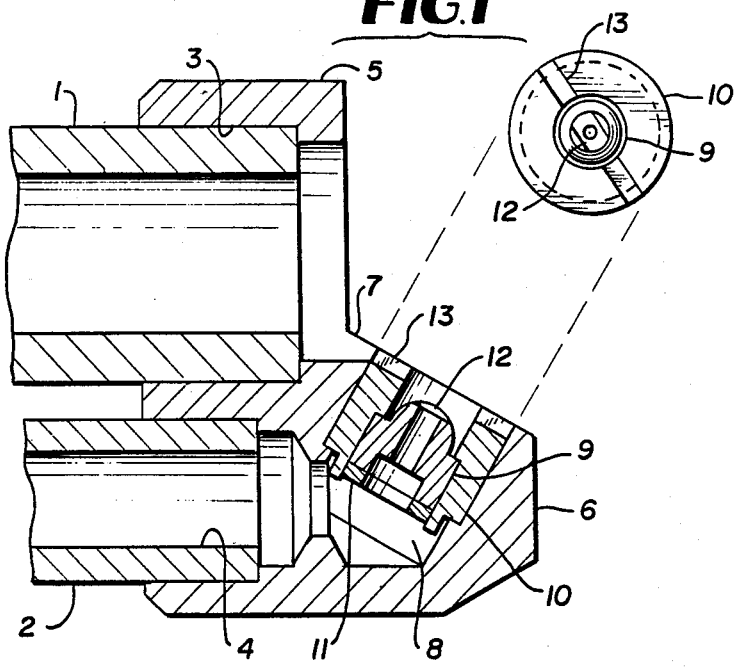
FIG. 1 is a cross section view of the sandblasting device with a plan view from top of the nozzle.

Referring to FIG. 1, the sandblasting device of this invention comprises a first conduit 1 for the conveyance by air under pressure of the abrasive particles (usually sand), and a second conduit 2, parallel to the first, for the conveyance of a pressurized fluid (preferably water).

The outlet ends of conduits 1 and 2 are secured, for example by threading, in their respective housings, 3 and 4, with a cylindrical terminal support 5. The terminal support 5 has an integral forward projection 6 positioned in front of housing 4. The latter has an upper flat external surface 7 inclined at a predetermined angle to the axes of conduits 1 and 2.

Housing 3 has a first axial passage for a direct outlet of the sand conveyed by the propelling air through conduit 1. Housing 4 extends through a second reduced passage into a cylindrical cavity 8. This cavity, which has a conical base, is contained within the forward projection 6 with a port on the inclined surface 7, and its axis perpendicular to that surface.

The portion of cavity 8 between the upper surface 7 of the forward projection 6 and the junction with the reduced outlet passage from conduit 2 is threaded to accept an inclined spraying nozzle 9 for the fluid under pressure conveyed through conduit 2.

Nozzle 9 has a cylindrical body with a substantially hemispherical top and an annular shoulder at its base. It is enclosed in a tubular nozzle holder 10. The nozzle holder 10 is threaded externally to correspond with the internal thread in cavity 8. Internally the nozzle holder has an axial stepped bore with a circular cross-section. The step is formed by a reduction in the major diameter.

Nozzle 9 is assembled in the holder 10, by inserting it into the end with the major diameter, until its annular shoulder abuts the step in the holder. The nozzle is locked in position by a stop ring 11, its hemispherical end extending into the reduced section of the bore.

It should be noted that the axial hole through nozzle 9 extends into a diametral groove 12 (this can best be seen in the plan view). This groove is machined in the hemispherical top of the nozzle, in order to create a fan-like spray of the fluid under pressure coming from conduit 1 via the communicating cavity 8.

This groove 12 is parallel to a groove 13 machined diametrally into a top surface of nozzle holder 10. After inserting the nozzle into the holder, as described above, a suitable tool such as a screwdriver utilizes this groove 13 to screw the nozzle holder into cavity 8. By adjusting the screwing of the nozzle holder 10 into the cavity 8 the orientation of the fan-like spray of fluid under pressure can be set. The parallelism of grooves 12 and 13 facilitates this choice of orientation.

During running, the sand, conveyed through conduit 1, is ejected by the propelling compressed air from the outlet of housing 3, of holder 5. Simultaneously the fluid under pressure, conveyed through conduit 2, comes out of nozzle 9 in the previously described fan-like jet.

Owing to the present inclination of the axis of nozzle 9 to the axis of conduit 1, and its relevant housing 3, the fan-like jet of pressurized fluid violently strikes the sand jet. The sand jet, with the mass of abrasive particles taking on a lenticular cross-section, is thrown against the surface to be cleaned with enhanced efficiency. By adjusting the screwing of nozzle holder 10 into cavity 8 the orientation of the fan-like jet, and hence the lentiular jet of sand, can be preset in accordance with the job requirements.

Figure 2:
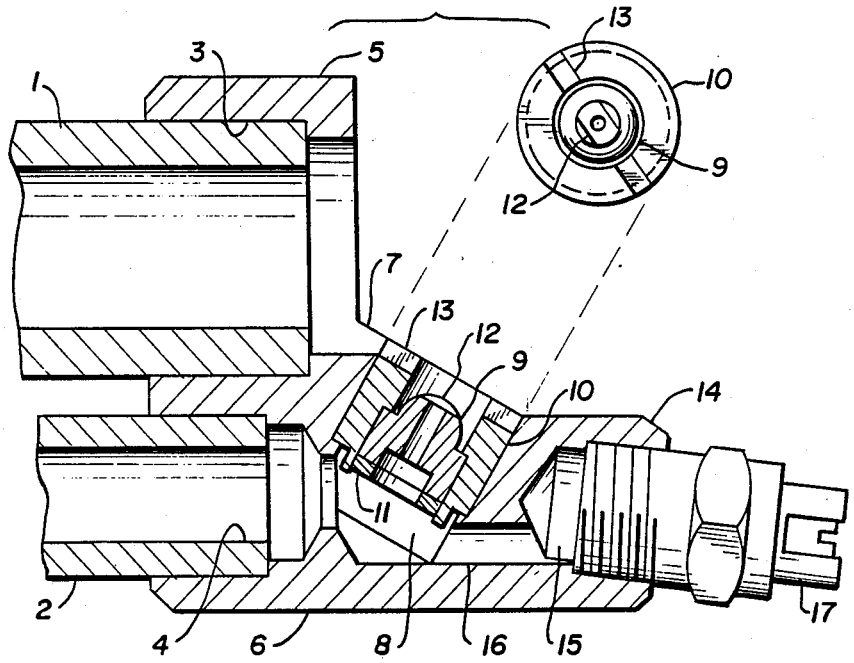
FIG. 2 shows an alternative embodiment of the sandblasting device as shown in FIG. 1.

Referring to FIG. 2, an alternative embodiment of the sandblasting device is shown.

In FIG. 2 similar parts described previously with reference to FIG. 1, will here be referred to by the same numerals and without further explanation.

It can be noted that the sandblasting device shown in FIG. 2 differs from that in FIG. 1 only by having a second means of expelling the fluid under pressure. This creates a fluid jet which does not interfere with the sand jet.

As can be seen in FIG. 2, the front face of forward projection 6 has an integral cylindrical addition, with its axis parallel to that of conduit 2. In the front face of this addition is a second cavity 15, which is threaded and of the same form as cavity 8. Cavity 15 is connected to cavity 8 by a communicating channel 16. The axis of cavity 15 is inclined slightly downwards in comparison to the axis of conduit 2. A conventional nozzle 17 is screwed into cavity 15.

Utilizing the alternative embodiment of this invention, as illustrated in FIG. 2, the surface to be sandblasted can be washed either after or at the same time as sandblasting that surface. This is made possible by the jet of fluid under pressure coming from nozzle 17.

The present invention is not limited to the examples illustrated in FIGS. 1 and 2, but covers any modification falling within the scope of the invention.

I claim:

1. A sandblasting device having a first conduit for the conveyance of abrasive particles to a first outlet end and a second parallel conduit for the conveyance of a pressurized fluid to a second outlet end, comprising: a terminal support including housings wherein said outlet ends of the conduits are respectively secured; a first passage coaxial to said first conduit for a direct outlet of the abrasive particles from said support; a second passage coaxial to said second conduit for an outlet of the fluid from said second conduit; a projection integral with the support in front of said second passage, said projection having a flat external surface located near said first passage and provided with a cylindrical cavity communicating said second passage with a port on said external surface, the axis of said cavity perpendicular to said surface being inclined in such a way that it meets the axis of said first conduit at an angle; a nozzle coaxially mounted into said cavity, said nozzle having an axial hole and a transverse groove machined across said hole at an outlet end of the nozzle, for forming a jet of pressurized fluid ejected in a fan-like spray; an integral addition on the front face of said projection, having a through passage in communication with said second conduit, and a second nozzle mounted in said through passage, for ejecting the pressurized fluid in a jet substantially parallel to the jet of abrasive particles and whereby the jet of abrasive particles coming from the first conduit is thrown against a surface to be cleaned at an angle controlled by the inclination of the axis of said nozzle and in the form of a jet having a transverse lenticular cross-section.

2. The device of claim 1, wherein said nozzle is rotatably mounted in said cavity in order to orientate, at will, the jet of pressurized fluid.

3. The device of claim 2, wherein said nozzle is threadedly engaged with said cavity.

4. Sandblasting device, as claimed in claim 1, in which the pressurized fluid is water under pressure.

5. Sandblasting device, as claimed in claim 1, in which the pressurized fluid is air under pressure.

6. Sandblasting device, as claimed in claim 1, in which the abrasive particles are sand.

7. The sandblasting device as claimed in claim 1, in which said nozzle mounted in said cavity is threadedly engaged with said cavity.

* * * * *

UNITED STATES PATENT AND TRADEMARK OFFICE

CERTIFICATE OF CORRECTION

PATENT NO. : 4,845,903

DATED : Jul. 11, 1989

INVENTOR(S) : WOODWARD

It is certified that error appears in the above-identified patent and that said Letters Patent is hereby corrected as shown below:

ON TITLE PAGE:

[30] Foreign Application Priority Data:

Delete "Jan. 19, 1987", insert therefor -- Jan. 16, 1987 --

Signed and Sealed this

Thirty-first Day of March, 1992

*Attest:*

*Attesting Officer*

HARRY F. MANBECK, JR.

*Commissioner of Patents and Trademarks*